US009362605B2

(12) United States Patent
Shinoda et al.

(10) Patent No.: US 9,362,605 B2
(45) Date of Patent: Jun. 7, 2016

(54) ELECTROMAGNETIC WAVE PROPAGATION PATH AND ELECTROMAGNETIC WAVE PROPAGATION DEVICE

(75) Inventors: Hiroshi Shinoda, Tokyo (JP); Takahide Terada, Tokyo (JP); Kazunori Hara, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 145 days.

(21) Appl. No.: 14/131,543

(22) PCT Filed: Jul. 11, 2011

(86) PCT No.: PCT/JP2011/065764

§ 371 (c)(1),
(2), (4) Date: Feb. 4, 2014

(87) PCT Pub. No.: WO2013/008292

PCT Pub. Date: Jan. 17, 2013

(65) Prior Publication Data

US 2014/0167882 A1 Jun. 19, 2014

(51) Int. Cl.

| | |
|---|---|
| ***H01P 5/12*** | (2006.01) |
| ***H01P 3/02*** | (2006.01) |
| ***H01P 5/02*** | (2006.01) |

(52) U.S. Cl.

CPC ..... *H01P 3/023* (2013.01); *H01P 5/028* (2013.01); *H01P 5/12* (2013.01)

(58) Field of Classification Search

CPC ..... H01P 3/023; H01P 5/028
USPC ..... 333/136
See application file for complete search history.

(56) References Cited

U.S. PATENT DOCUMENTS

2013/0229240 A1* 9/2013 Terada et al. ..... 333/137
2014/0354417 A1* 12/2014 Terada et al. ..... 340/10.4

FOREIGN PATENT DOCUMENTS

| | | | |
|---|---|---|---|
| JP | 2002-353707 | A | 12/2002 |
| JP | 2010-021822 | A | 1/2010 |
| JP | 2010-056952 | A | 3/2010 |
| JP | 2010-074790 | A | 4/2010 |
| JP | 2010-074791 | A | 4/2010 |

* cited by examiner

*Primary Examiner* — Robert Pascal
*Assistant Examiner* — Kimberly Glenn
(74) *Attorney, Agent, or Firm* — Mattingly & Malur, PC

(57) ABSTRACT

An electromagnetic wave propagation device includes multiple planar propagation media each formed by laminating at least one planar conductor and at least one planar dielectric, multiple transceivers for transmitting and receiving information among electronic apparatuses, and a first interface for transmitting and receiving the electromagnetic wave between the transceivers and the planar propagation media. Planar dielectric spacers are provided for isolating the multiple planar propagation media from one another. The planar propagation medium is disposed to have an overlapped part with at least the other of the planar propagation media so that an obverse face of the medium and a reverse face of the other medium are at least partially overlapped with each other. The planar conductor is provided with an electromagnetic wave linking unit at the overlapped part that transmits and receives the electromagnetic wave between the planar propagation media.

15 Claims, 15 Drawing Sheets

ELECTROMAGNETIC WAVE PROPAGATION PATH AND ELECTROMAGNETIC WAVE PROPAGATION DEVICE

TECHNICAL FIELD

The present invention relates to an electromagnetic wave propagation path and an electromagnetic wave propagation device, and more specifically, to an electromagnetic wave propagation path and an electromagnetic wave propagation device which employ planar propagation media for propagating electromagnetic waves, and are suitable for three-dimensional branching extension.

BACKGROUND ART

The recent advancement of networking electronic apparatuses in various fields of consumer and social infrastructures shows the trend of significant increase in the number of wiring cords for connecting those electronic apparatuses. Similarly, in the housing of the electronic apparatus, the numbers of modules that constitute the electronic apparatus, and the wiring cords among the electronic components have been increasing, which interferes with the effort of downsizing the electronic apparatus, reducing the cost, and improving reliability.

Introduction of the generally employed wireless communication system such as wireless LAN is one of measures taken for reducing the number of wirings. However, there may be a concern that the metal wall surface of the housing in the wireless communication system irregularly reflects the electromagnetic wave, thus destabilizing communication quality.

The generally employed detachable connector for wire connection of the electronic apparatuses has problems in regards to reliability and cost, demanding the connection between components without exposing the electrode, requiring no physical attachment-detachment.

Patent Literature 1 discloses the planar propagation medium as the technology to solve the aforementioned problem. Such medium is configured to interpose a planar dielectric between two planar conductors for enabling transmission of the electromagnetic waves therebetween, and form one of the planar conductors into a mesh structure to dispose the interface of the electromagnetic wave propagation device via a thin film dielectric, which enables the electromagnetic wave to pass in and out through evanescent wave that has oozed around the mesh conductor. The aforementioned technology as disclosed in the literature has the thin film dielectric intervening between the mesh conductor serving as the electrode and the interface, thus requiring no physical attachment-detachment, and allowing connection between the components without exposing the electrode. The electromagnetic wave which propagates in the dielectric, which is called the surface wave, is confined in the planar propagation medium, and electric power is two-dimensionally transmitted along the planar propagation medium. As a result, leakage of the electromagnetic wave to the outside of the planar propagation medium is small, and the problem of destabilizing communication quality owing to the irregular reflection hardly occurs even if it is confined in the closed space inside the metal housing. The structure has a feature of high resistance to the interference wave from the outside by another system. Patent Literature 1 discloses the technology for extending the single planar propagation medium towards the two-dimensional spreading direction. In other words, Patent Literature 1 discloses extension of the planar propagation medium with low loss by facing opposite end surfaces of two planar propagation media with each other, and allowing a pair of conductor plates to interpose the connection part from the obverse and reverse faces.

Patent Literature 2 discloses the technology that relates to branching extension of the high frequency line. That is, Patent Literature 2 discloses the technology that relates to the strip line configured to laminate the dielectric layer and a pair of ground layers each composed of the conductive material to interpose the dielectric layer from the vertical direction to cover the surface of the dielectric layer, and to include a signal line composed of the conductive material as well to be disposed inside the dielectric layer. The literature discloses bonding of two strip lines having openings in the ground layers for branching the electromagnetic wave.

CITATION LIST

Patent Literature

Patent Literature 1: Japanese Patent Application Laid-Open No. 2010-056952
Patent Literature 2: Japanese Patent Application Laid-Open No. 2002-353707

SUMMARY OF THE INVENTION

Problem to be Solved by the Invention

The technology for extending the planar propagation medium as disclosed in Patent Literature 1 describes the two-dimensional extension of the medium size using a pair of conductor plates. It is difficult to apply the technology to the three-dimensional branching extension for spreading the electromagnetic waves to a large number of electronic apparatuses and electronic components which are three-dimensionally disposed in the housing. Patent Literature 1 is not limited to the structure to which the planar propagation medium is connected in the same plane. The literature describes an example that allows connection of the medium at any inclination angle so as to be bent at the connected end portion. The example is applicable to the continuous surface such as the inner wall surface of indoor. However, the literature addresses no branching extension. It is therefore thought to be difficult to apply the aforementioned technology to the three-dimensional arrangement having multiple sterically arranged surfaces.

The branching extension technology of the high frequency line as disclosed in Patent Literature 2 is assumed to have the strip line. Ground layers formed in openings of the two strip lines are in physical contact, and have exposed electrodes which contact the communication device of the electronic apparatus. It is not desirable to expose the electrode as it is liable to wear upon removal of the single strip line with the component disposed thereon outside the electronic apparatus for maintenance such as replacement of parts. The strip line disclosed in Patent Literature 2 has two obverse and reverse ground layers. Since each electromagnetic wave energy between the respective ground layers and the signal line becomes an equally divided half, although the opening is formed in the single ground layer, the electromagnetic wave energy equal to or higher than ½ cannot be transmitted, it is therefore difficult to achieve highly efficient transmission.

Patent Literature 2 discloses the application of the high frequency strip line to the indoor wireless LAN system. The wireless communication between the master machine and multiple adapters of the wireless LAN system causes irregular reflection of the electromagnetic wave by the metal wall surface of the indoor housing, resulting in the problem of destabilized communication quality.

In view of the aforementioned problem, it is an object of the present invention to provide an electromagnetic wave propagation path and an electromagnetic wave propagation device which allow three-dimensional branching extension of the planar propagation medium without exposing the electrode, requiring no physical attachment-detachment, while keeping low loss and low leakage.

Means for Solving the Problem

A typical example of the present invention will be described. The electromagnetic wave propagation device according to the present invention includes multiple planar propagation media, planar dielectric spacers disposed for isolating the multiple planar propagation media from one another, and a first interface for transmitting and receiving an electromagnetic wave between the planar propagation media and a transceiver. Each of the planar propagation media is formed by laminating at least one planar conductor and at least one planar dielectric. Each of the planar propagation media is disposed to have an overlapped part with at least another of the planar propagation media. The planar conductor is provided with an electromagnetic wave linking unit at the overlapped part that transmits and receives the electromagnetic wave between the planar propagation media.

Advantageous Effect of Invention

The electromagnetic wave propagation device according to the present invention allows branching extension of the propagation path with low loss while keeping the low leakage characteristic and high resistance to the interference wave. This allows highly reliable communication with multiple communication terminals which are three-dimensionally disposed at various positions inside the housing.

MODE FOR CARRYING OUT THE PRESENT INVENTION

Figure 1A:
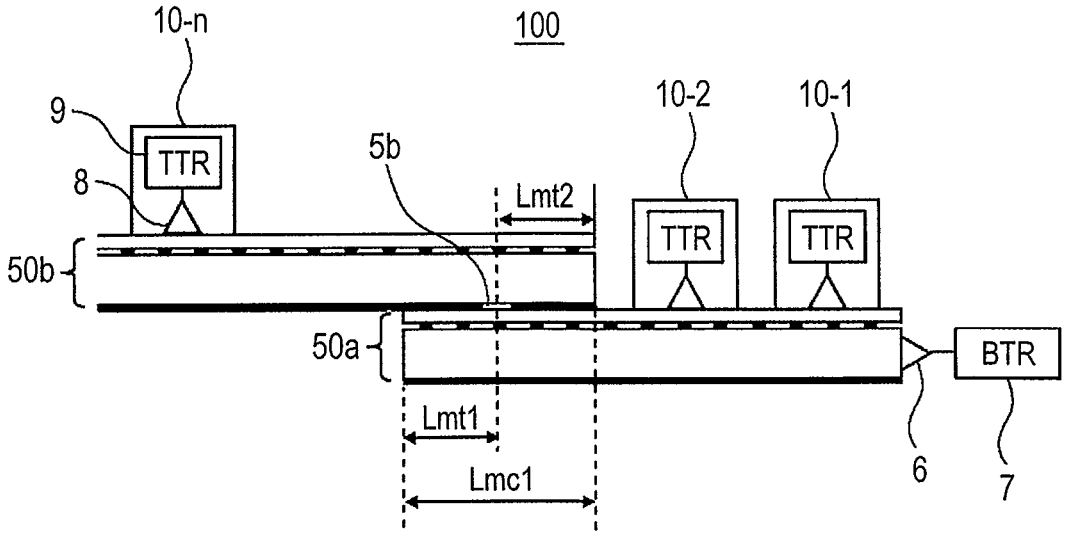
FIG. 1A is a sectional view of an electromagnetic wave propagation device according to a first embodiment of the present invention, showing an example of an electromagnetic wave linking unit for two planar propagation media that form the electromagnetic wave propagation path.

Aiming at achievement of the above-described object, a typical embodiment of the present invention is configured such that the electromagnetic wave propagation device includes multiple planar propagation media each formed by laminating at least one planar conductor and at least one planar dielectric, multiple transceivers for transmitting and receiving information between electronic apparatuses, and a first interface for transmitting and receiving the electromagnetic wave between the transceivers and the planar propagation media. The electromagnetic wave propagation device includes planar dielectric spacers among the multiple planar propagation media for individual isolation. The planar propagation media are disposed such that the respective obverse faces overlap at least partially with the respective reverse faces of at least another of the planar propagation media. The planar conductor at the overlapped part is provided with an electromagnetic wave linking unit that functions as a second interface for transmitting and receiving the electromagnetic wave between the planar propagation media.

The electromagnetic wave propagation device allows the branching extension of the propagation path with low loss while keeping the low leakage characteristic and the high resistance to the interference wave. This makes it possible to provide highly reliable communication with the multiple communication terminals disposed at various positions in the housing. The multiple planar propagation media may be connected under the condition where the electrode is not exposed and physical fixation is not required, thus reducing the assembly cost and the maintenance cost. It is possible to provide insulation between the two planar propagation media, and between the planar propagation medium and the communication terminal disposed thereon, respectively in the low frequency band near DC. It is therefore helpful in the usage requiring insulation between the planar propagation medium and the communication terminal at different ground potentials. The highly flexible substrate with thickness of 100 microns or smaller may be used for forming the planar propagation medium, which allows easy mounting irrespective of the housing configuration.

The electromagnetic wave propagation device as a specific form of the embodiment is configured to include at least one of the planar propagation media, which is formed by laminating the planar conductor, the planar dielectric and the planar mesh conductor sequentially in this order, using the planar mesh conductor as the first interface.

The electromagnetic wave propagation device according to the embodiment is allowed to carry out the stabilized communication irrespective of the position of the communication terminal on the planar propagation medium.

The electromagnetic wave propagation device as another specific form of the embodiment is configured to include at least one of the planar propagation media, which is formed by laminating the first planar conductor, the planar dielectric and the second planar conductor sequentially in this order, using the slot formed in the second planar conductor as the first interface.

The electromagnetic wave propagation device according to the embodiment is allowed to improve the propagation efficiency in the planar propagation medium by reducing the electromagnetic wave leakage from the position other than the predetermined position of the communication terminal.

The electromagnetic wave propagation device as another specific form of the embodiment is configured to include a slot (opening) as at least one of the electromagnetic wave linking units in the planar conductor at the overlapped part between at least two of the planar propagation media.

The electromagnetic wave propagation device according to the embodiment is allowed to improve the propagation efficiency between the planar propagation media, and to make the propagation efficiency variable in accordance with the slot dimension.

The electromagnetic wave propagation device as another specific form of the embodiment is configured to include the mesh structure as at least one of the electromagnetic wave linking units for the planar conductor at the overlapped part between at least two of the planar propagation media.

The electromagnetic wave propagation device according to the embodiment is allowed to lessen fluctuation in the propagation efficiency between the planar propagation media owing to the positional displacement in the spreading direction of the planar propagation medium.

The electromagnetic wave propagation device as another specific form of the embodiment is configured to include multiple planar propagation media each composed of a first planar propagation medium and multiple second planar propagation media. The second planar propagation medium includes the overlapped part structured to have at least a part overlapped between an obverse face of the medium and a reverse face of the other medium with respect to the propagation direction of the electromagnetic wave in the first planar propagation medium, and the other part bent to the overlapped part to incline the propagation direction of the electromagnetic wave to the second planar propagation media.

The electromagnetic wave propagation device according to the embodiment is allowed to carry out branching extension in various directions while keeping the low leakage characteristic and high resistance to the interference waves.

Embodiments of the present invention will be described in detail referring to the drawings.

First Embodiment

A first embodiment according to the present invention will be described referring to FIGS. 1A to 3.

Figure 1B:
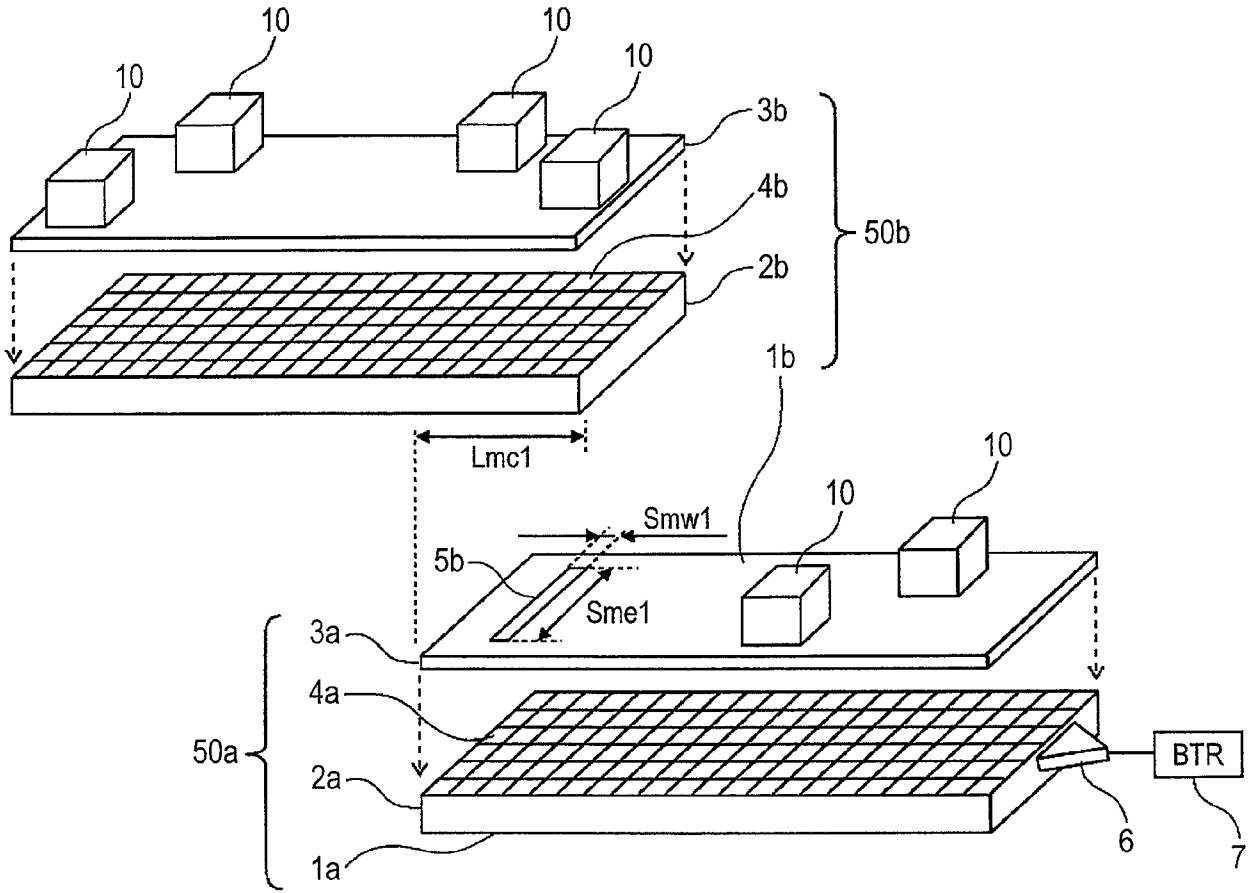
FIG. 1B is an exploded perspective view of an essential surface representing an exemplary structure of the electromagnetic wave propagation device provided with the electromagnetic wave linking unit as shown in FIG. 1A.

FIG. 1A illustrates an example of an electromagnetic wave linking unit for two planar propagation media that form an electromagnetic wave propagation path of an electromagnetic wave propagation device according to the first embodiment. FIG. 1B is an exploded perspective view of major surfaces of the electromagnetic wave propagation device for easy understanding of the structure.

An electromagnetic wave propagation device 100 is a device for transmitting and receiving information between at last one communication base station 7 and multiple communication terminals 10 (10-1 to **10-*n*), which includes planar propagation media 50*a*, 50*b*, and a parallel transformation type interface 6. The respective communication terminals 10 are transceivers installed in the multiple electronic apparatuses as communication modules for communication with the communication base station 7. Frequency of the electromagnetic wave employed for communication may be set to 2.5 GHz and 900 MHz. The communication terminal 10 includes a vertical transformation type interface 8 and a transceiver 9, which transmits and receives communication signals to and from the communication base station 7 via the parallel transformation type interface (third interface) 6 and the planar propagation media 50*a*, 50*b***.

The two planar propagation media **50*a*, 50*b* are disposed in superposition having each part around end portion, for example, overlapped between an obverse face of the medium and a reverse face of the other. The overlapped part is provided with the electromagnetic wave linking unit to form a propagation path of the electromagnetic wave as the communication signal. The first and the second planar propagation media 50*a* and 50*b* are formed by laminating planar conductors 1*a*, 1*b*, planar dielectrics 2*a*, 2*b*, planar mesh conductors 4*a*, 4*b*, and planar dielectric spacers 3*a*, 3*b*** sequentially in this order, respectively.

The planar mesh conductors **4*a*, 4*b* spread to form grid patterns, and are capable of controlling the amount of the electromagnetic wave which oozes to the outside in accordance with the pitch of meshes. The electromagnetic wave that oozes outside, which is called evanescent wave attenuates exponentially with respect to the propagation distance. Typically, the attenuation distance of amplitude to 1/e is approximately 1 cm (e: the base of natural logarithms). Therefore, it is possible to make the unwanted radiation outside significantly small by locally positioning the electromagnetic wave only around the planar mesh conductor 4*b*. It is hardly influenced by the interference wave from outside based on the reversibility principle of the radiation element. The planar mesh conductor 4*b* functions as the interface (first interface) with the communication terminals 10**.

Considering the propagation efficiency, it is preferable to use the material with low dielectric constant and low dielectric loss tangent for forming the planar dielectrics **2*a*, 2*b*. The planar dielectric spacers 3*a*, 3*b* protect the planar mesh conductors 4*a*, 4*b*, respectively. At the same time, the planar dielectric spacer 3*a* serves to provide insulation between the two planar propagation media 50*a* and 50*b*, and the planar dielectric spacer 3*b* serves to provide insulation between the planar propagation medium 50*b* and the communication terminals 10** disposed thereon in the low frequency band near DC, respectively.

It is assumed that the overlapped distance between the two planar propagation media **50*a* and 50*b* is designated as L. The embodiment designates L as Lmc1 (L=Lmc1), the distance from the end surface of the first planar propagation medium 50*a* to the slot 5*b* as Lmt1, and the distance from the end surface of the second planar propagation medium 50*b* to the slot 5*b* as Lmt2, respectively. The slot 5*b* formed at the overlapped part L serves as the interface (second interface) which transmits and receives the electromagnetic waves between the first and the second planar propagation media 50***a* and 50*b*. In other words, the slot 5*b* functions as the electromagnetic wave linking unit.

FIG. 1B shows the slot 5*b* in the planar dielectric spacer 3*a* for easy identification. However, this slot 5*b* may be formed in the lower surface of the second planar propagation medium 50*b*. Alternatively, each layer of the electromagnetic wave propagation device 100 including the slot 5*b* may be further finely subdivided. The electromagnetic wave propagation device 100 shown in FIGS. 1A and 1B may have arbitrarily grouped constituent elements so long as the aforementioned structure is established. Furthermore, the manufacturing method may be selected in accordance with the grouping (the following embodiments apply as well).

The parallel transformation type interface 6 is used for connecting the communication base station 7 and the planar propagation medium 50*a*, both of which are arranged parallel to the advancing direction of the electromagnetic wave so as to carry out mode conversion of the electromagnetic wave output from the communication base station 7, that is, coaxial line into the surface wave mode of the planar propagation medium 50*a*. The communication base station 7 is the device which carries out transmission and reception of the communication signal with the communication terminals 10 via the parallel transformation type interface 6 and the planar propagation media 50*a*, 50*b*. The vertical transformation type interface 8 for the communication terminal 10 is used for receiving the communication signal from the planar propagation medium 50*b*, and disposed perpendicularly to the advancing direction of the electromagnetic wave of the planar propagation medium 50*b*. Then the mode conversion of the electromagnetic wave is carried out from the surface wave mode of the planar propagation medium 50*b* to the coaxial line mode. In this way, the electromagnetic wave is converted from the surface wave mode to the evanescent wave, and further to the coaxial line mode.

The planar propagation media 50*a*, 50*b* allow wide range propagation of the electromagnetic wave called surface wave while spreading two-dimensionally, respectively. In this case, the explanation will be made on the assumption that the surface wave propagates from the parallel transformation type interface 6 along the longitudinal direction of the planar propagation medium 50*a* as a typical example. Two end surfaces of the planar propagation media 50*a*, 50*b* in the short-length direction have open-circuit structures. Accordingly, it is possible to propagate the electromagnetic wave in all frequency bands without limiting the dimension. However, if those two end surfaces are short-circuited, the dimension has to be selected so that each length of the planar propagation media 50*a* and 50*b* in the short-length direction is set to ½ λg (λg: effective wave length) or longer. If the planar propagation medium 50*b* has the reflection end with the short-circuit, or open-circuit structure, the standing wave inside is excited to cause variation in the electromagnetic wave energy depending on the position of the communication terminal 10 provided on the medium. This may cause deviation in communication quality. In order to cope with the aforementioned phenomenon, it is effective to provide the radio wave absorber which is operated in the frequency band in use on the end surface of the planar propagation medium 50*b*.

As described above, the slot 5*b* formed at the overlapped part around an end portion of the planar conductor 1*b* serves as the interface (second interface) which transmits and receives the electromagnetic wave between the two planar propagation media 50*a* and 50*b*. Since the slot 5*b* is electromagnetically shielded with the planar mesh conductors 4*a* and 4*b*, the unwanted radiation to the outside may be made significantly small. Furthermore, the slot is hardly influenced by the interference wave from the outside. It is assumed that the dimension of the slot 5*b* is determined by designating the length in the longitudinal direction of the planar propagation medium 50*a* as Smw1, and the length in the short-length direction as Sme1. Preferably, the slot 5*b* serves to excite the resonance at the frequency λg in use for good propagation efficiency between the planar propagation media, and the length in the short-length direction is set to $Sme1 \approx (2n-1) \cdot \lambda g/2$. The term n denotes a natural number. Meanwhile, the length Smw1 in the longitudinal direction is set to 0.1 mm or longer as the minimum processing dimension of the printed circuit board in general, which may cause no problem. In the case where multiple planar propagation media are used, it is possible to adjust the propagation efficiency for each slot by increasing or decreasing the aforementioned dimension. The position of the slot by itself may be positionally offset to the long side of the planar propagation medium 50*a* as the adjustment unit. Various propagation modes are established in accordance with the frequency of the electromagnetic wave to be propagated to the planar propagation medium 50*a*. Therefore, it is effective to replace the dimension of the Smw1 with Sme1 so as to positionally offset to the long side of the planar propagation medium 50*a*, make a rotation at 45° with respect to the centroid of the slot as the axis, make the slot to have a cross shape, and the like.

According to the present invention, the partial overlap between the two planar propagation media is not limited to the area near the end portion. For example, the area of the first planar propagation medium 50*a* at the lower side is larger than the area of the second planar propagation medium 50*b* at the upper side, and they are partially overlapped at the inner side of the end of the first planar propagation medium 50*a* while having the obverse face of the medium partially overlapped with the reverse face of the other.

Figure 2:
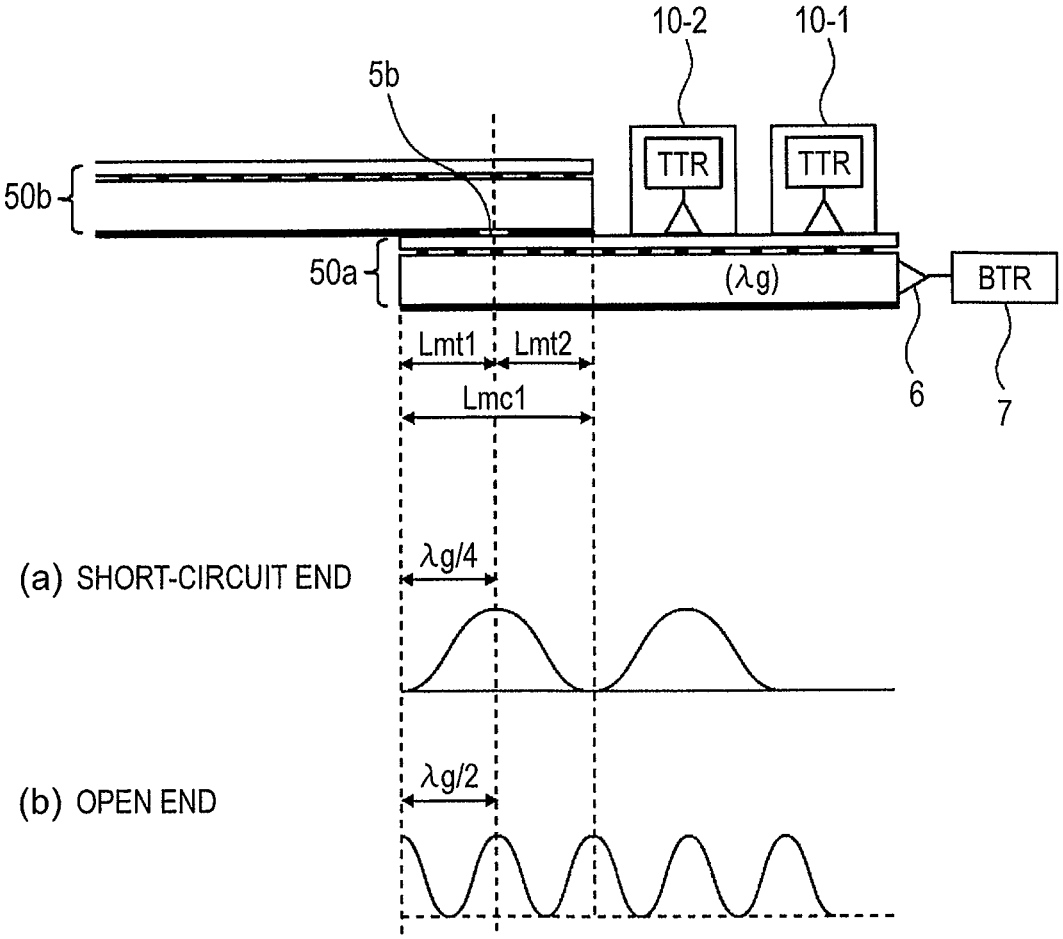
FIG. 2 is an explanatory view of a structure of the electromagnetic wave linking unit according to the first embodiment.

FIG. 2 is a sectional view of the electromagnetic wave propagation device 100 having two planar propagation media 50*a*, 50*b* partially overlapped for extension. The planar propagation medium 50*a* has the characteristic impedance which differs between the overlapped part (L=Lmc1) with the planar propagation medium 50*b* and the non-overlapped part. Therefore, the surface wave is reflected by the boundary between the overlapped and non-overlapped parts, which may cause the problem of positional variation in communication quality owing to deteriorated overall propagation efficiency and excited standing wave. It is preferable to set $Lmc1 \approx (2n-1) \cdot \lambda g/4$ for minimizing the reflection.

The Lmt1 and Lmt2 may be set to values for maximizing the electric field intensity at the position of the slot 5*b* for improving its propagation efficiency. If the planar propagation media 50*a* and 50*b* have open-circuit end surfaces (FIG. 2(*b*)), it is preferable to set $Lmt1=Lmt2 \approx n \cdot \lambda g/2$. If they have the short-circuit ends with metal (FIG. 2(*a*)), it is preferable to set $Lmt1=Lmt2 \approx (2n-1) \cdot \lambda g/4$.

The description has been made as described above on the assumption that the same material is used for forming the planar propagation media 50*a*, 50*b*, each of which has the same thickness. If the material and the thickness are different, the values of Lmt1 and Lmt2 have to be individually set.

Figure 3:
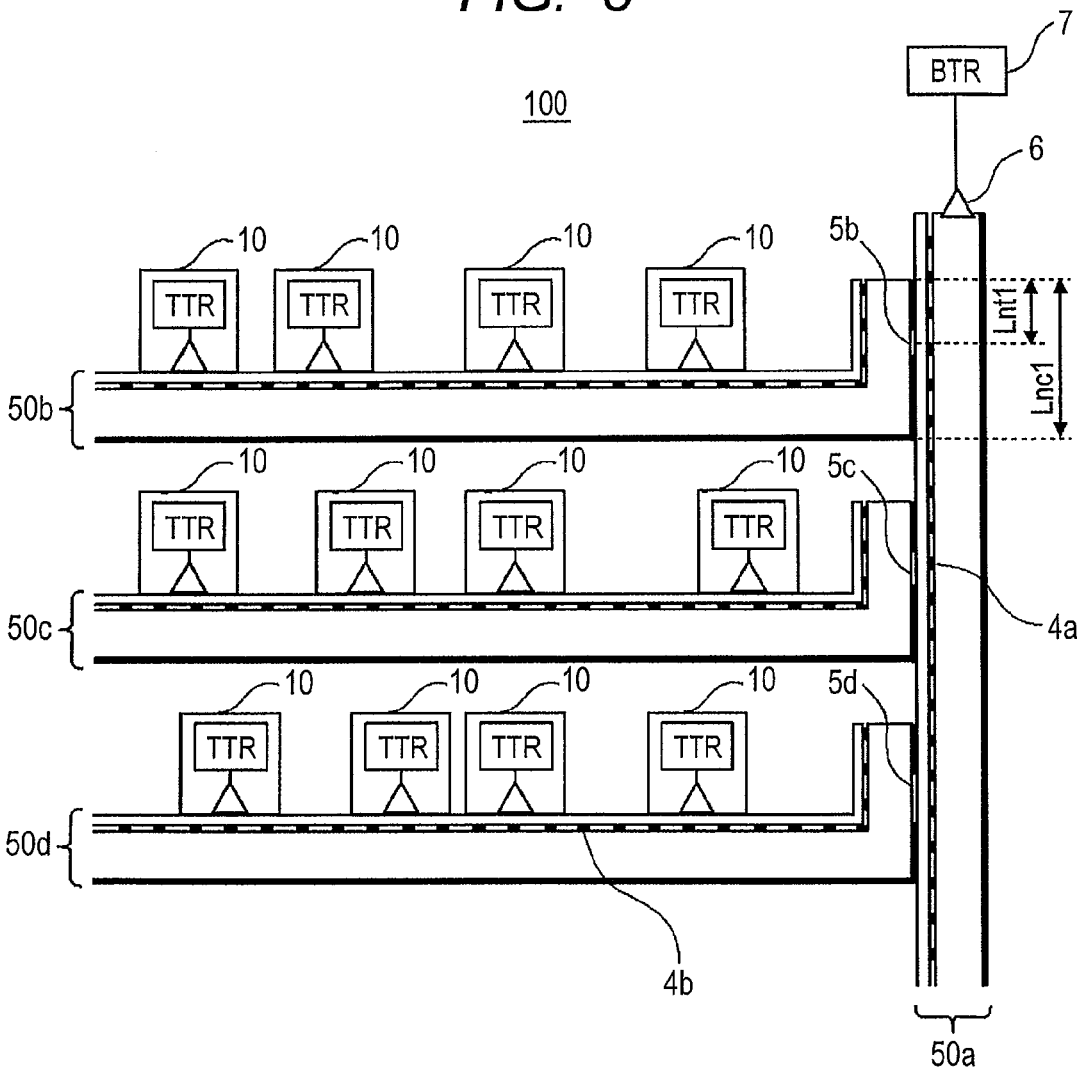
FIG. 3 is a sectional view showing an exemplary three-dimensional branching extension of the planar propagation media according to the first embodiment.

FIG. 3 is a sectional view of the electromagnetic wave propagation device 100 in which a single linear planar propagation medium (first planar propagation medium) 50*a* has its surface partially overlapped with multiple L-shaped planar propagation media (second planar propagation media) 50*b* to 50*d* around end portions thereof for realizing the three-dimensional branching extension. The multiple second planar propagation media 50*b* to 50*d* are connected to the first planar propagation medium 50*a* along the axial direction at predetermined intervals. The electromagnetic wave from the first planar propagation medium 50*a* is input to the second planar propagation media 50*b* to 50*d* via the slots 5*b* to 5*d* each as the electromagnetic linking unit formed at the overlapped part with the length of Lnc1 in the same propagation direction as that of the first planar propagation medium 50*a*.

Each of the multiple second planar propagation media 50*b* to 50*d* has the L-like bent portion perpendicular to the first planar propagation medium 50*a* in order to propagate the electromagnetic wave in the direction perpendicular to the propagation direction of the surface wave inside the planar propagation medium 50*a*, and further to adjust the length of the overlapped part so that the distribution ratio of the electromagnetic wave to the branched path is variable. In this drawing, the planar propagation media 50*b* to 50*d* have bent portions at right angles for easy understanding. It is to be clearly understood, however, that they may be bent by applying gentle corner roundness in order to further lessen the propagation loss and reflection loss.

The slot dimension has to be adjusted as described above to substantially equalize the respective distribution ratios of the electromagnetic waves from the first planar propagation medium 50*a* to the second planar propagation media 50*b* to 50*d*. Typically, as the second planar propagation media (50*b*, 50*c*, 50*d*) are farther apart from the parallel transformation type interface 6, the dimensions (corresponding to Smw1, Sme1 shown in FIG. 1B) of the corresponding slots (5*b*, 5*c*, 5*d*) are made larger stepwise to establish substantially the equal distribution ratios.

The dimension L of the overlapped part will be described by taking the overlapped part between the planar propagation media 50*a* and 50*b* as the typical example. It is assumed that the distance of the overlapped part is designated as Lnc1, and the distance from the end surface of the planar propagation medium 50*b* to the slot 5*b* is designated as Lnt1. It is also assumed that the same material is used for forming the planar propagation media 50*a*, 50*b*, each of which has the same thickness. As described above, the planar propagation medium 50*a* has different characteristic impedance between the overlapped part with the planar propagation medium 50*b* and the non-overlapped part. The surface wave is reflected by the boundary between those parts, which causes the problem of positional variation in communication quality owing to deteriorated overall propagation efficiency and excited standing wave. It is preferable to set $Lnc1 \approx (2n-1) \cdot \lambda g/4$ to minimize the reflection. The Lnt1 is determined to the value for maximizing the electric field intensity at the position of the slot 5*b* so as to improve its propagation efficiency. If the planar propagation medium 50*b* has the open-circuit end surface, it is preferable to set $Lnt1 \approx (2n \cdot \lambda g/2$. If the planar propagation medium has the short-circuit end surface, it is preferable to set $Lnt1 \approx (2n-1) \cdot \lambda g/4$. The same setting applies to the slots 5*c* and 5*d*. It is also possible to use the Lnc1 and Lnt1 as parameters for changing the distribution ratio.

The embodiment describes branching extension of the propagation path using two or four planar propagation media. It is possible to carry out the branching extension using more planar propagation media. The single slot is used for connecting the two planar propagation media. It is possible to form two or more slots for improving the propagation efficiency between the media.

The embodiment has been explained as the structure having the lower surface of the communication terminal in contact with the planar propagation medium. However, the structure may have its top and bottom inverted so that the upper surface of the communication terminal is in contact with the planar propagation medium.

The electromagnetic wave propagation device 100 according to the first embodiment connects the multiple planar propagation media with one another via the slots (second interfaces) so as to allow the branching extension of the propagation path, especially the three-dimensional branching extension with low loss while keeping the low leakage characteristic and high resistance to the interference wave. This makes it possible to enable the highly reliable communication with the multiple communication terminals which are three-dimensionally disposed at various positions in the housing via the electromagnetic wave propagation path.

According to the first embodiment, the multiple planar propagation media may be connected without exposing the electrode, requiring no physical fixation. This makes it possible to reduce the assembly cost and the maintenance cost.

According to the first embodiment, the planar mesh conductor has a periodic structure. The value of Sme1 as the slot dimension is made sufficiently shorter than the length of the planar propagation medium in the short-length direction. This makes it possible to lessen fluctuation in the propagation efficiency between the planar propagation media owing to positional displacement in the spreading direction of the planar propagation medium.

According to the first embodiment, the planar dielectric spacers allow insulation between the two planar propagation media, and between the planar propagation medium and the communication terminal disposed thereon, respectively in the low frequency band near DC. It is therefore helpful in the usage requiring insulation between the planar propagation medium and the communication terminal at different ground potentials.

According to the first embodiment, for example, the highly flexible film substrate with thickness of 100 microns or smaller may be used as the planar propagation medium. It is therefore easy to mount the planar propagation medium in the housing with an arbitrary configuration with a flat or curved surface.

The first embodiment has been described in the form of the communication device. It is possible to modify the structure by replacing the communication base station 7 and the transceiver 9 with the power transmission device and the power receiving device, respectively so as to transmit the electromagnetic wave as power for activating the electronic apparatus instead of using the communication signal. It is to be clearly understood that the combined structure allows simultaneous or time-division transmission of both of them.

Second Embodiment

A second embodiment according to the present invention will be described referring to FIGS. 4 to 9.

Figure 4:
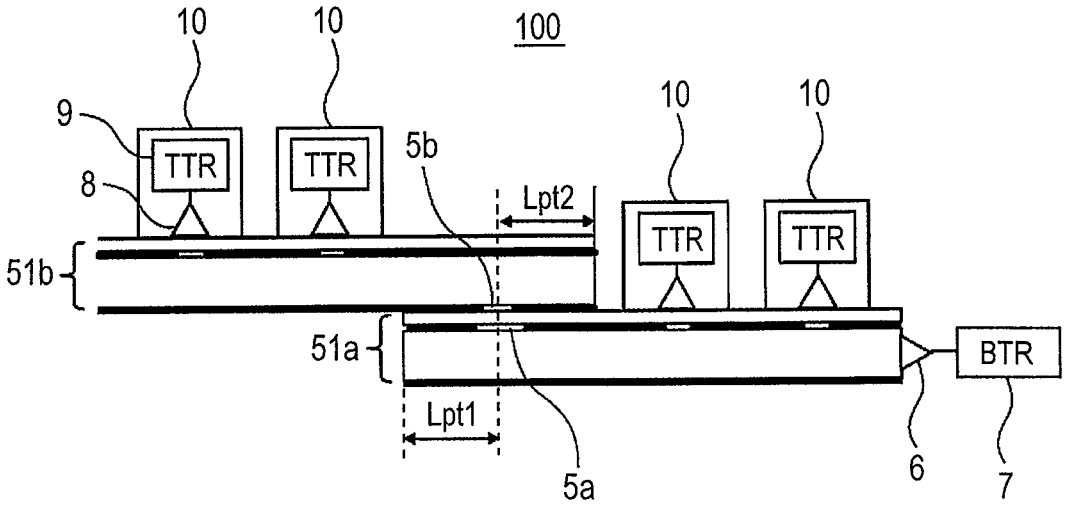
FIG. 4 is a sectional view of the electromagnetic wave linking unit for the planar propagation media of the electromagnetic wave propagation device according to a second embodiment of the present invention.

FIG. 4 is a sectional view of the electromagnetic wave linking unit for the planar propagation media of the electromagnetic wave propagation device according to the second embodiment.

The electromagnetic wave propagation device 100 serves to transmit and receive information between the communication base station 7 and the communication terminals 10, and includes planar propagation media 51*a*, 51*b*, and the parallel transformation type interface 6.

The two planar propagation media 50*a*, 50*b* are disposed to have the respective regions around end portions partially superposed while having the obverse face of the medium and the reverse face of the other medium overlapped. The electromagnetic linking unit is provided at the overlapped part to form the propagation path for the electromagnetic wave as the communication signal. It is assumed that the distance of the overlapped part is designated as L. In the embodiment, the distance from the end surface of the planar propagation medium 51*a* to the slot 5*a* is designated as Lpt1, and the distance from the end surface of the planar propagation medium 51*b* to the slot 5*b* is designated as Lpt2. The distance of the overlapped part is derived from L=Lpt1+Lpt2.

The respective values of Lpt1 and Lpt2 for maximizing the electric field intensity at the positions of the slots 5*a* and 5*b* are determined to improve the propagation efficiencies of the slots 5*a* and 5*b*. If each of the planar propagation media 51*a* and 51*b* has the open-circuit end surface, it is preferable to set Lpt1=Lpt2≈n·λg/2. If each of them has the short-circuit end surface, it is preferable to set Lpt1=Lpt2≈(2n−1)·λg/4. In the aforementioned case, it is assumed that the same material is used for forming the planar propagation media 51*a* and 51*b*, each of which has the same thickness. If the material and thickness are different, it is necessary to set the Lpt1 and Lpt2, individually.

Figure 5:
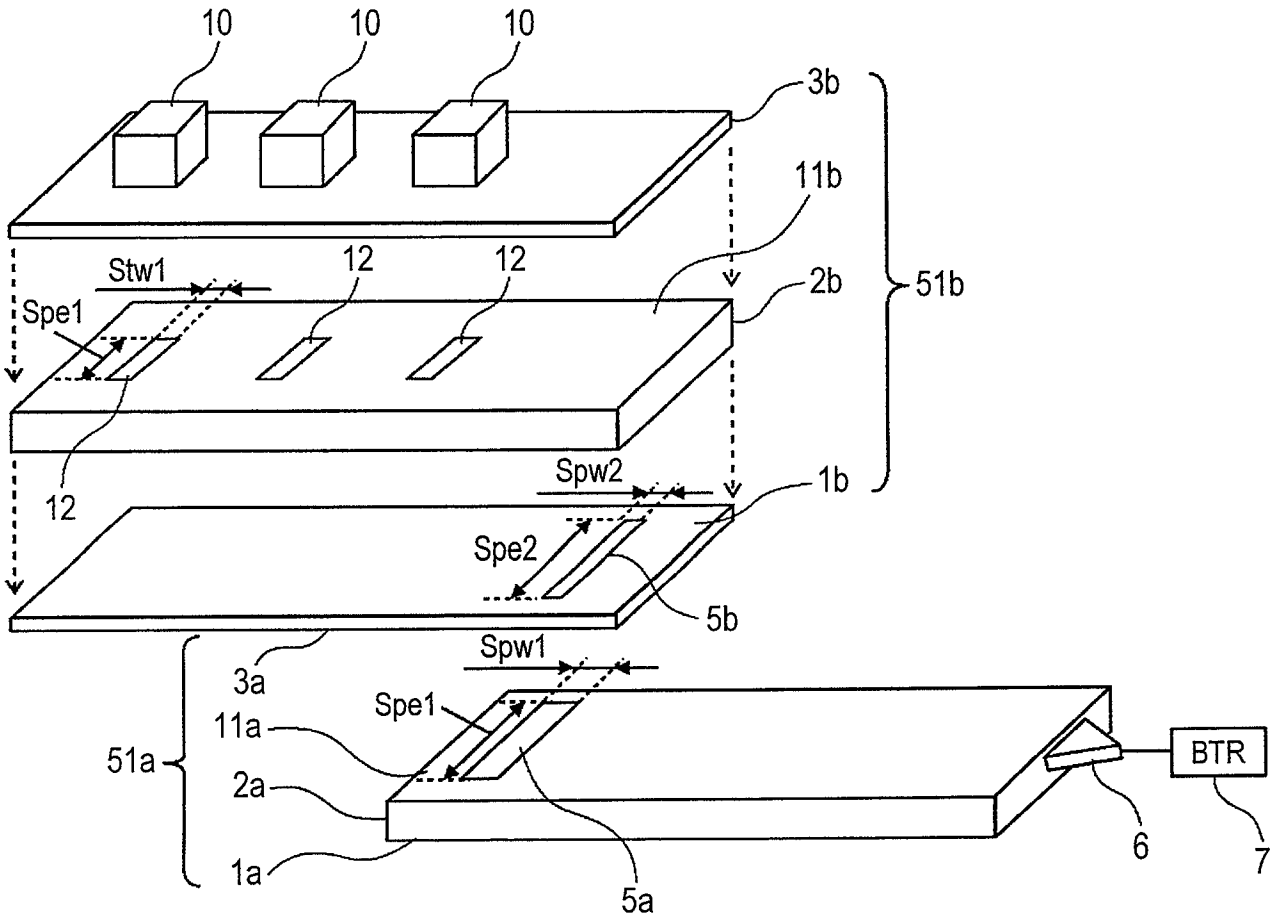
FIG. 5 is an exploded perspective view showing an exemplary structure of the electromagnetic wave propagation device according to the second embodiment.

FIG. 5 is an exploded perspective view showing the major surfaces of the electromagnetic wave propagation device according to the second embodiment.

The two planar propagation media 51*a*, 51*b* are disposed to have the respective regions around end portions overlapped with each other. The electromagnetic linking unit is provided at the overlapped part to form the propagation path for the electromagnetic wave as the communication signal. The planar propagation media 51*a*, 51*b* are formed by laminating the planar conductors 1*a*, 1*b*, the planar dielectrics 2*a*, 2*b*, the planar conductors 11*a*, 11*b*, and the planar dielectric spacers 3*a*, 3*b*, sequentially in the aforementioned order.

The planar propagation media 51*a*, 51*b* allow propagation of the electromagnetic wave in parallel plate mode over a wide range while two-dimensionally spreading. The explanation will be made on the assumption that the electromagnetic wave propagates from the parallel transformation type interface 6 along the longitudinal direction of the planar propagation medium 51*a*, as a typical example. The structure has two open-circuit end surfaces of the planar propagation media 51*a*, 51*b* (parallel plate mode) in the short-length directions. This makes it possible to carry out the electromagnetic wave propagation in all frequency bands without limiting the dimension. If the two end surfaces have the short-circuit structures, the dimension has to be selected so that each length of the planar propagation media 51*a* and 51*b* in the short-length direction is equal to ½ λg or longer in order to allow propagation of the waveguide mode. If the end surface of the planar propagation medium 51*b* has the short-circuit or open-circuit reflection structure, the standing wave is excited inside, and the electromagnetic wave energy to be received may vary in accordance with the position of the communication terminal 10 disposed on the medium. This may cause deviation in communication quality. In order to cope with the aforementioned phenomenon, it is effective to provide the radio wave absorber which is activated in the usage frequency band at the end surface of the planar propagation medium 51*b*.

The slots 12 are formed in the planar conductor 11*b*, and used for transmitting and receiving the communication signals to and from the communication terminals 10 disposed just above the planar conductor 11*b*. The slot 12 functions as the interface (first interface) with the communication terminal 10. The dimension of the slot 12 is determined by designating the longitudinal length of the planar propagation medium 51*b* as Stw1, and the length in the short-length direction as Ste1. The slot 12 may have its length set to Ste1≈(2n−1)·λn/2 for radiation outside by its own resonance like the slots 5*a* and 5*b* as described below. It is also effective to control the radiation amount to a minimum required value for communication by setting Ste1<<λg/2. More preferably, it is configured to resonate at the operating frequency when the vertical transformation type interface 8 is positioned just above the slot. As a result, the unwanted radiation to the outside may be significantly reduced. The reversible principle of the radiation element results in the little influence of the interference wave from the outside. FIG. 5 shows three slots 12 each with the same size. However, it is effective to set the Ste1 of the two center slots to the value smaller than the Ste1 of the slot 12 located at the end. It is preferable to employ the material with low dielectric constant and low dielectric loss tangent for forming the planar dielectrics 2*a* and 2*b* in consideration of the propagation efficiency. The planar dielectric spacers 3*a* and 3*b* protect the planar conductors 11*a* and 11*b*. The planar dielectric spacer 3*a* provides insulation between the two planar propagation media 51*a* and 51*b*, and the planar dielectric spacer 3*b* provides insulation between planar propagation medium 51*b* and the communication terminal 10 disposed thereon, respectively in the low frequency band near DC.

The slots 5*a*, 5*b* formed at the overlapped parts of the planar conductors 11*a* and 1*b* serve as the second interfaces for transmitting and receiving the electromagnetic wave between the two planar propagation media 51*a* and 51*b*. Since the slots 5*a*, 5*b* are electromagnetically shielded with the planar conductors 1*a* and 11*b*, the unwanted radiation to the outside may be significantly reduced. They are hardly influenced by the interference wave from the outside. It is assumed that dimensions of the slots 5*a*, 5*b* are determined by designating the longitudinal length of the planar propagation medium 51*a* as Spw1, Spw2, and the length in the short-length direction as Spe1, Spe2, respectively. The slot may be configured to have excitation of resonance at the usage frequency in order to improve the propagation efficiency between the planar propagation media. The relationship set to Spe1≠Spe2 allows decrease in the sensitivity of positional displacement between the slots 5*a* and 5*b*. It is therefore preferable to set Spe1≥(2n−1)·λg/2≥Spe2. Meanwhile, the Spw1 and Spe2 have values set to be equal to or longer than 0.1 mm as the general minimum processing dimension for the printed board. It is preferable to set Spw1 Spw2 as described above. The explanation has been made on the assumption that the slot 5*a* is larger than the slot 5*b*. The same effect may also be derived from the opposite relationship of the size.

In the case where the multiple planar propagation media are used, it is possible to adjust the propagation efficiency for each slot by increasing or decreasing the dimension as described above. The position of the slot may be offset towards the long side of the planar propagation medium 51*a* as the adjustment unit. Since various propagation modes are established depending on the frequency of the electromagnetic wave that is propagated to the planar propagation medium 51*a*, the relationship with respect to dimensions of the short side and the long side of the slots 5*a* and 5*b* is reversed so as to make a positional offset towards the long side of the planar propagation medium 51*a*. Alternatively, it is also effective to rotate the centroid position of the slot at 45°, or to form the slot into a cross shape.

Figure 6:
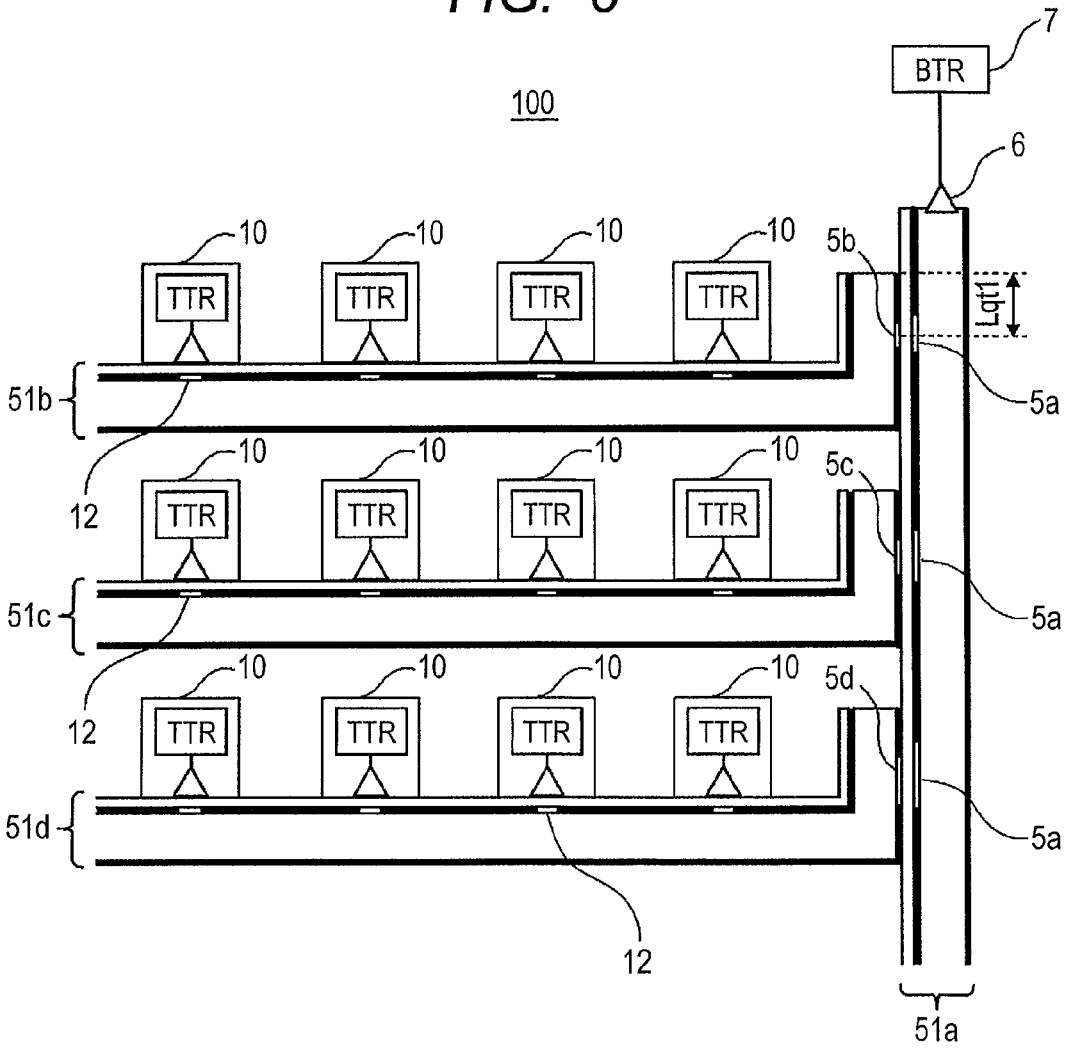
FIG. 6 is a sectional view showing an example of a three-dimensional branching extension of the planar propagation media according to the second embodiment.

FIG. 6 is a sectional view of the electromagnetic wave propagation device 100 in which the single planar propagation medium (first planar propagation medium) 51*a* and the multiple planar propagation media (second planar propagation media) 51*b* to 51*d* are disposed, and the respective parts near ends thereof are connected to the first planar propagation medium for realizing the three-dimensional branching extension. The planar propagation media 51*b* to 51*d* are bent perpendicularly to the planar propagation medium 51*a* in order to propagate the electromagnetic wave in the direction perpendicular to the propagation direction of the surface wave in the planar propagation medium 50*a*. Referring to the drawing, the planar propagation media 51*b* to 51*d* are bent at right angles for easy understanding. However, it is to be clearly understood that they may be bent to apply gentle roundness to the respective corners so as to lessen the propagation loss and the reflection loss.

The electromagnetic wave from the first planar propagation medium 51*a* is input to the second planar propagation media 51*b* to 51*d* via the corresponding slots 5*b* to 5*d*, respectively. The slot dimension has to be adjusted as described above for substantially equalizing the distribution ratios to the planar propagation media 51*b* to 51*d*. Typically, as the second planar propagation media 51*b*, 51*c* and 51*d* are farther apart from the parallel transformation type interface 6, each size of the slots 5*a* in the respective stages, and the slots 5*b*, 5*c* and 5*d* is increased to enable substantially equal distribution ratios.

The position of the slot 5*b* will be described as a representative example. It is assumed that the distance from the end surface of the planar propagation medium 51*b* to the slot 5*b* is designated as Lqt1, and the same material is used for forming the planar propagation media 50*a* and 50*b*, each of which has the same thickness. The propagation efficiency of the slots 5*a* and 5*b* may be improved by determining the Lqt1 for maximizing the electric field intensity at positions of the slots 5*a* and 5*b*. It is preferable to set $Lqt1 \approx n \cdot \lambda g/2$ if the planar propagation media 51*a*, 51*b* have open-circuit end surfaces, and to set $Lqt1 \approx (2n-1) \cdot \lambda g/4$ if they have short-circuit end surfaces. The aforementioned setting applies to the slots 5*c* and 5*d*. The Lqt1 may be used as the parameter for changing the distribution ratio.

Figure 7:
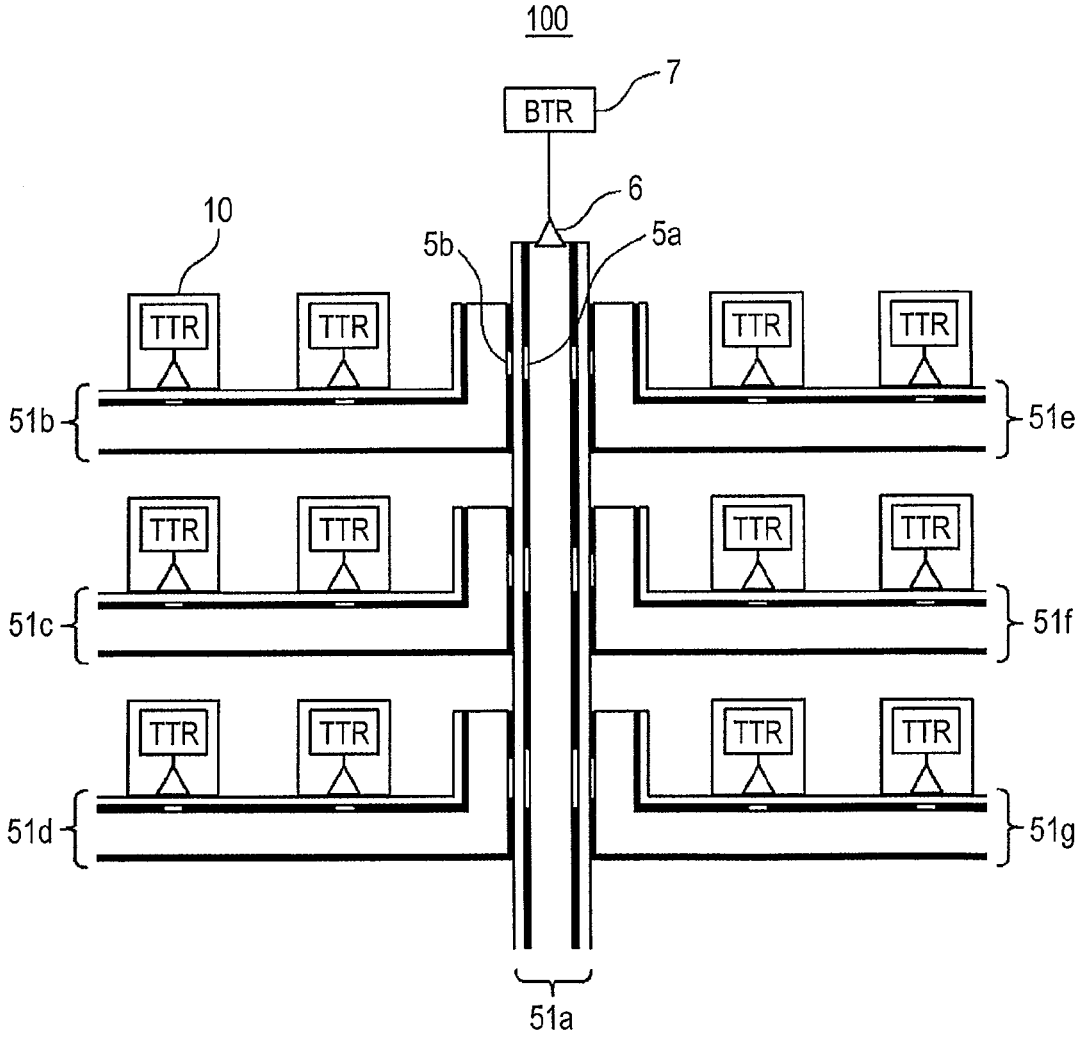
FIG. 7 is a sectional view showing another example of branching extension of the electromagnetic wave propagation device according to the second embodiment.
Figure 8:
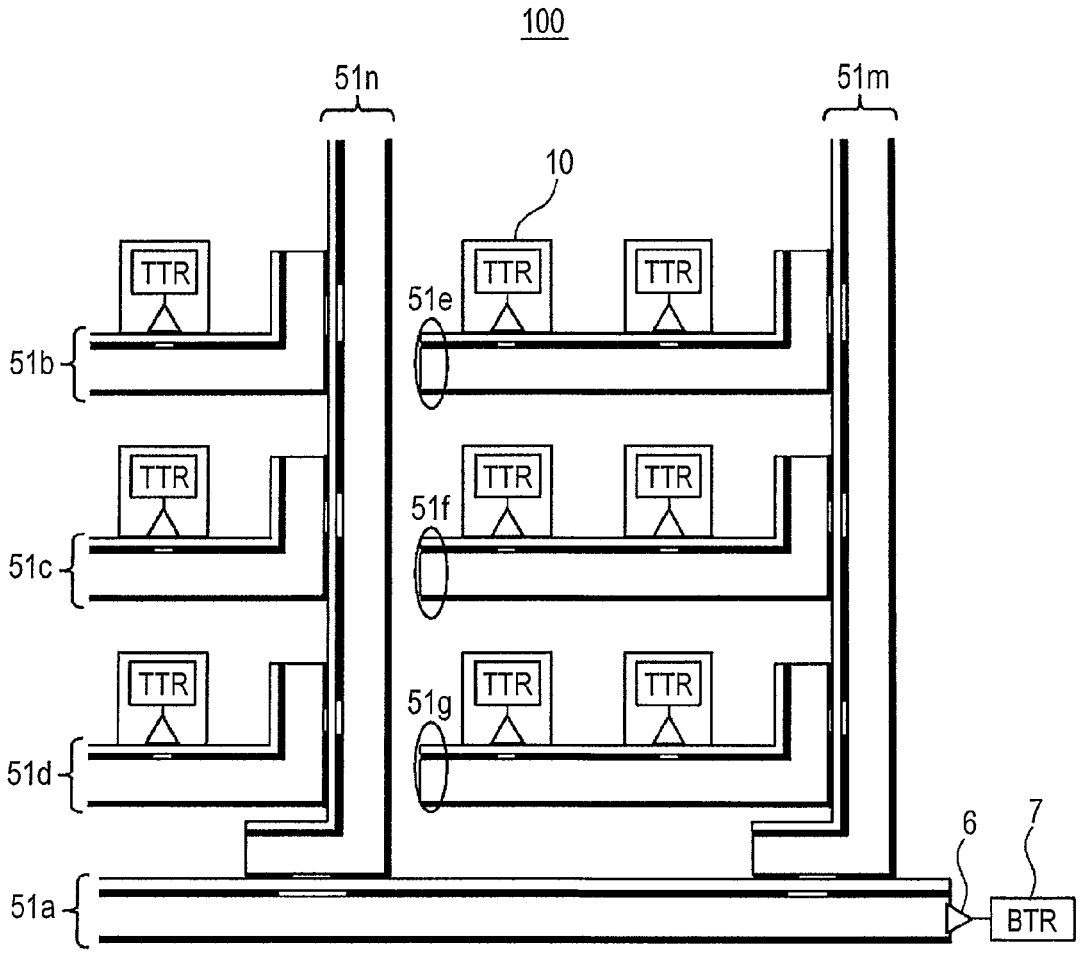
FIG. 8 is a sectional view showing another example of branching extension of the electromagnetic wave propagation device according to the second embodiment.
Figure 9:
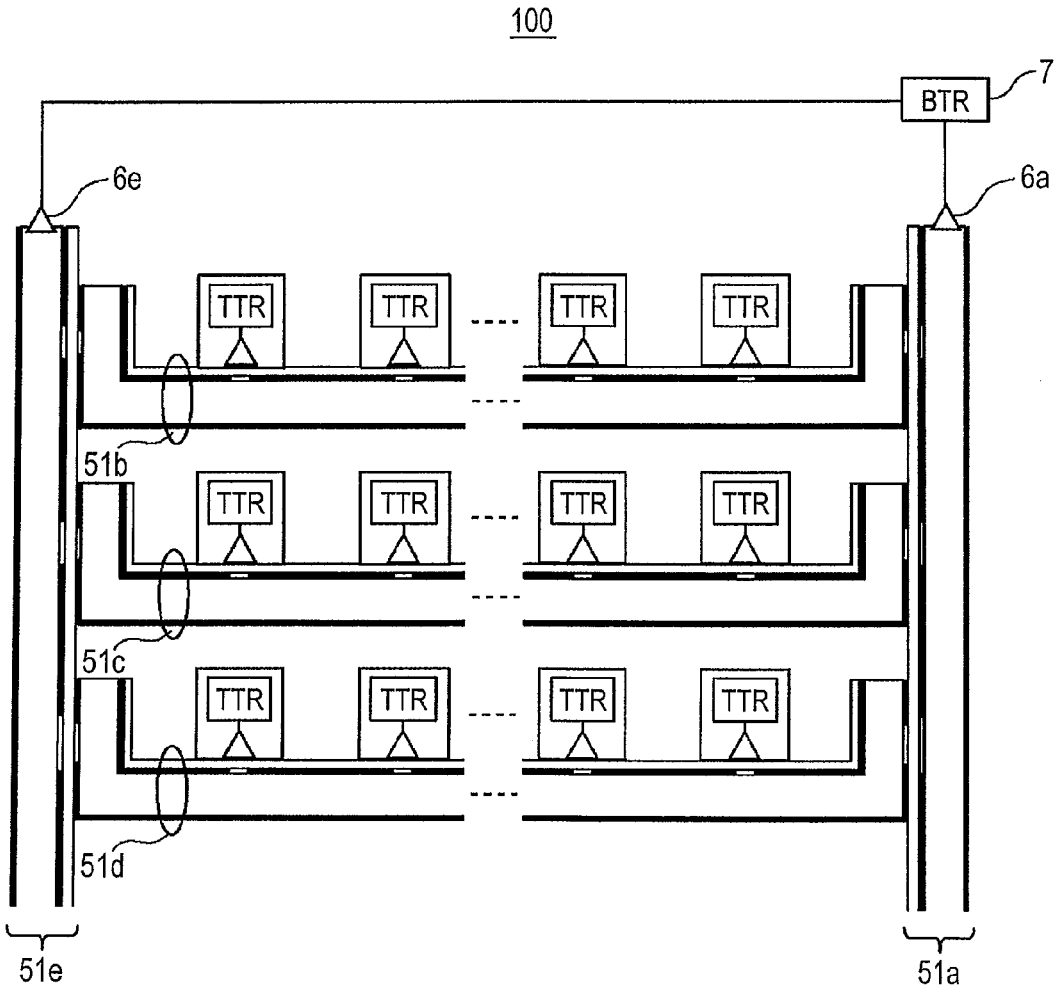
FIG. 9 is a sectional view showing another example of branching extension of the electromagnetic wave propagation device according to the second embodiment.

FIGS. 7 to 9 show modified examples of three-dimensional branching in the electromagnetic wave propagation device 100 according to the embodiment.

Referring to the electromagnetic wave propagation device 100 shown in FIG. 7, the slots 5*a* are formed in both surfaces of the major planar propagation medium (first planar propagation medium) 51*a* at the center, which are connected to two groups of the (second) planar propagation media (51*b* to 51*d*, 51*e* to 51*g*) at left and right sides as branch paths. The electromagnetic wave propagation device 100 shown in FIG. 8 is configured such that multiple (second) planar propagation media 51*m*, 51*n* as branch paths extend from the lower planar propagation medium (first planar propagation medium) 51*a* as the main path. The (second) planar propagation media (51*b* to 51*d*, 51*e* to 51*g*) each serving as the branch path from the corresponding planar propagation media 51*m*, 51*n* are connected thereto, respectively. Both electromagnetic wave propagation devices 100 shown in FIGS. 7 and 8 have three-dimensional arrangements, which are applicable to the housing with more complicated configuration.

The electromagnetic wave propagation device 100 shown in FIG. 9 is configured such that a communication signal is input to a pair of (first) planar propagation media 51*a*, 51*e* from the communication base station 7 via the two parallel transformation type interfaces 6 for connection to the multiple (second) planar propagation media (51*b* to 51*d*) each as the branch path, respectively. It is assumed that the pair of planar propagation media 51*a* and 51*e* are disposed at the side surfaces inside the housing. However, the housing machining accuracy is not sufficient for the application to the large general-purpose housing. This may generate the gap with approximately 1 mm between the planar propagation medium 51*a* and connection surfaces of the planar propagation media 51*b* to 51*d*, for example. The gap may cause the risk of deteriorating communication quality. This structure has a two-input system which ensures communication using the planar propagation medium 51*a* or 51*e* which has the smaller gap for lessening the adverse effect of the gap. Application of frequency difference and phase difference upon the two-system input may be the effective unit for improving communication quality.

It is to be clearly understood that the use of a unit that links the planar propagation media according to the first and the third embodiments may realize the electromagnetic wave propagation device 100 with the similar structure as shown in FIGS. 7 to 9.

The embodiment has described the typical example of branching extension of the propagation path formed by means of the multiple planar propagation media. The planar propagation media may be configured through combination and replacement in a similar manner as described above. The two planar propagation media are connected through the single set of slots. It is possible to use two or more sets of slots for further improving the propagation efficiency between those media.

The electromagnetic wave propagation device 100 according to the second embodiment is configured to connect the multiple planar propagation media via the slot set to enable branching extension of the propagation path with low loss while keeping low leakage characteristic and high resistance to the interference wave. This makes it possible to carry out highly reliable communication with the multiple communication terminals which are three-dimensionally disposed at various positions in the housing.

The second embodiment allows the multiple planar propagation media to be connected without exposing the electrode, requiring no physical fixation, thus reducing the assembly cost and maintenance cost.

The second embodiment may lessen fluctuation of the propagation efficiency between the two planar propagation media caused by the positional displacement in the spreading direction by setting sizes of the two slots for connecting the two planar propagation media to different values.

The second embodiment uses the planar dielectric spacers for insulation between the two planar propagation media, and between the planar propagation medium and the communication terminal disposed thereon in the low frequency bands near DC, respectively. It is helpful for the usage requiring insulation between the planar propagation medium and the communication terminal at different ground potentials.

The second embodiment allows the use of the film substrate with high flexibility, which has the thickness of 100 microns or smaller as the planar propagation medium. The resultant medium may be easily mounted in the housing irrespective of the housing configuration with flat surface or curved surface.

The second embodiment has described the communication device as an example. However, the communication base station 7 and the transceiver 9 may be replaced with the power transmission device and the power receiving device to allow transmission of the electromagnetic wave as the power for activating the device instead of the communication signal. It is to be clearly understood that the combined structure allows simultaneous or time-division transmission of both of them.

Third Embodiment

A third embodiment according to the present invention will be described referring to FIGS. 10 to 13.

Figure 10:
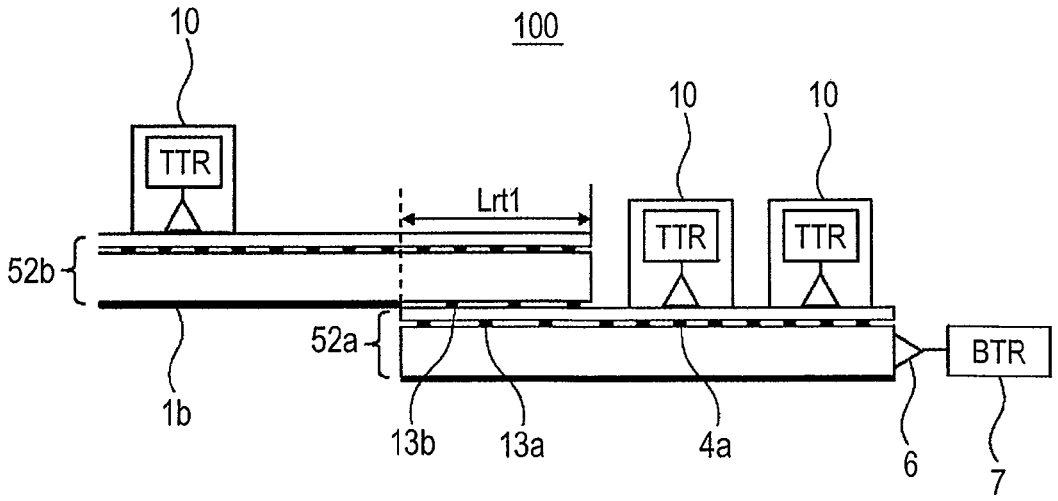
FIG. 10 is a sectional view of the electromagnetic wave linking unit for the planar propagation media of the electromagnetic wave propagation device according to a third embodiment.

FIG. 10 is a sectional view showing a structure of the electromagnetic wave propagation device 100 according to the third embodiment. The electromagnetic wave propagation device 100 serves to transmit and receive information between the communication base station 7 and the communication terminals 10, and includes the planar propagation media 52*a*, 52*b*, and the parallel transformation type interface 6.

The two planar propagation media 52*a* and 52*b* are partially overlapped (distance of the overlapped part=Lrt1). They are provided with the electromagnetic wave linking unit including a sparse mesh conductor 13*a* with a mesh pitch larger than that of the planar mesh conductor 4*a* at the non-overlapped part provided for the medium 52*a*, and a sparse mesh conductor 13*b* provided for the planar conductor 1*b* of the medium 52*b*. This makes it possible to connect the two planar propagation media 52*a* and 52*b* to form the propagation path of the electromagnetic wave as the communication signal. That is, the sparse mesh conductors 13*a*, 13*b* serve as the electromagnetic wave linking unit (second interface) that transmits and receives the electromagnetic wave between the two planar propagation media 52*a* and 52*b*. The mesh pitch at the overlapped part between the two planar propagation media 52*a* and 52*b* is increased to allow improvement in the propagation efficiency between those media. Typically, the planar mesh conductor 4*a* has the pitch ranging from $1/20\,\lambda g$ to $1/10\,\lambda g$, and each pitch of the sparse mesh conductors 13*a* and 13*b* is set to $1/4\,\lambda g$ or larger.

Like the first embodiment, each of the two planar propagation media 52*a* and 52*b* is formed by sequentially laminating the members of the planar conductor, the planar dielectric, the planar mesh conductor, and the planar dielectric. The planar mesh conductor above the planar dielectric spacer 3*a* functions as the interface (first interface) with the communication terminals 10.

The planar propagation media 52*a*, 52*b* with the two-dimensional spreading feature allow propagation of the electromagnetic wave called surface wave over a wide range. The description will be made on the assumption that the surface wave is propagated from the parallel transformation type interface 6 along the longitudinal direction of the planar propagation media 52*a*, 52*b* as a typical example. The planar propagation medium 52*a* has different characteristic impedance values between the overlapped part with the planar propagation medium 52*b* and the non-overlapped part. The surface wave is reflected by the boundary between those parts, thus causing the problem of positional variation in communication quality owing to deteriorated overall propagation efficiency and excited standing wave. It is preferable to set $Lrt1 \approx (2n-1)\cdot\lambda g/4$ for minimizing the reflection. When placing importance on the improvement in the propagation efficiency, the Lrt1 is determined for excitation of the resonance at the overlapped part. If the planar propagation media 52*a*, 52*b* have open-circuit end surfaces, it is preferable to set $Lrt1 \approx n\cdot\lambda g/2$. If those media have short-circuit ends, it is preferable to set $Lrt1 \approx (2n-1)\cdot\lambda g/4$. The description has been made on the assumption that the same material is used for forming the planar propagation media 52*a* and 52*b*, each of which has the same thickness.

Figure 11:
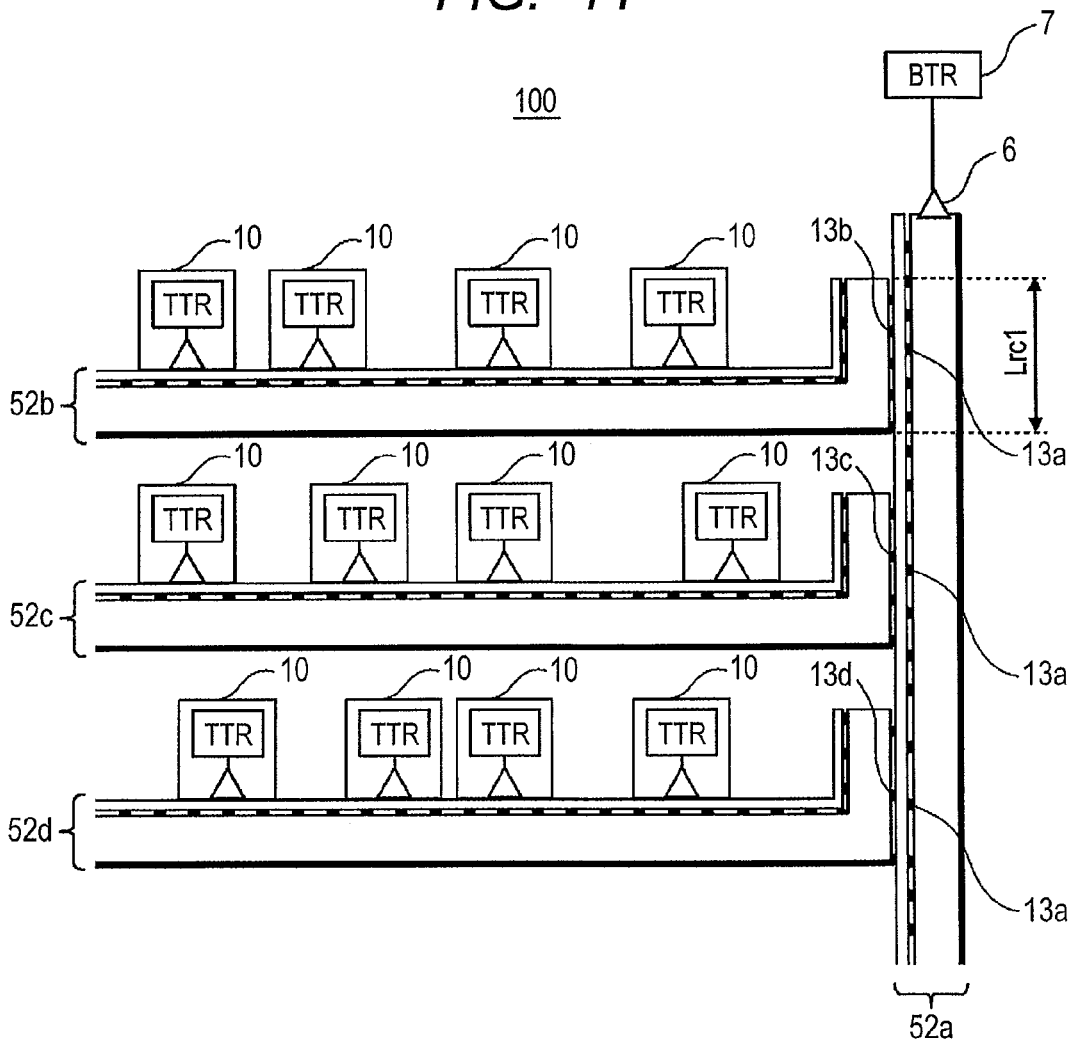
FIG. 11 is a sectional view showing an exemplary three-dimensional branching extension of the planar propagation media of the electromagnetic wave propagation device according to the third embodiment.

FIG. 11 is a sectional view of the electromagnetic wave propagation device 100 configured such that the single planar propagation medium (first planar propagation medium) 52*a* and multiple planar propagation media (second planar propagation media) 52*b* to 52*d* are disposed, which are partially overlapped with one another at areas around the respective end portions for realizing the three-dimensional branching. The second planar propagation media 52*b* to 52*d* are bent to be perpendicular to the first planar propagation medium 52*a* for propagating the electromagnetic wave in the direction perpendicular to the propagating direction of the surface wave inside the planar propagation medium 52*a*, and further adjusting the length of the overlapped part to make the distribution ratios of the electromagnetic wave to the branched paths variable. The drawing shows that the planar propagation media 52*b* to 52*d* are bent at right angles for easy understanding. It is to be clearly understood that application of the gentle roundness to the corners will further lessen the propagation loss and reflection loss.

The electromagnetic wave from the first planar propagation medium 52*a* is input to the multiple second planar propagation media 52*b* to 52*d* via the respective sparse mesh conductors 13*b* to 13*d*. In order to substantially equalize the distribution ratios to the respective second planar propagation media 52*b* to 52*d*, the mesh pitch at the overlapped part has to be adjusted as described above. Typically, as the second planar propagation media 52*b*, 52*c*, 52*d* are farther apart from the parallel transformation type interface 6, the respective mesh pitches of the sparse mesh conductors 13*b*, 13*c*, 13*d* are increased correspondingly to allow substantially equal distribution ratios.

The dimension of the overlapped part will be described, taking the overlapped part between the planar propagation media 52*a* and 52*b* as a typical example. It is assumed that the distance of the overlapped part is designated as Lrc1, and the same material is used for forming the planar propagation media 52*a*, 52*b*, each of which has the same thickness. As described above, the planar propagation medium 52*a* has different characteristic impedance values between the overlapped part with the planar propagation medium 52*b*, and the non-overlapped part. As a result, the surface wave is reflected by the boundary between those parts, thus causing the problem of the positional variation in communication quality owing to deteriorated overall propagation efficiency and excited standing wave. In order to minimize the reflection, it is preferable to set $Lrc1 \approx (2n-1)\cdot\lambda g/4$. When placing importance on improvement in the propagation efficiency, the Lrc1 is set to the value for exciting the resonance at the overlapped part. If the planar propagation media 52*a* and 52*b* have the open-circuit end surfaces, it is preferable to set $Lrc1 \approx n\cdot\lambda g/2$. If they have the short-circuit end surfaces, it is preferable to set $Lrc1 \approx (2n-1)\cdot\lambda g/4$.

Figure 12:
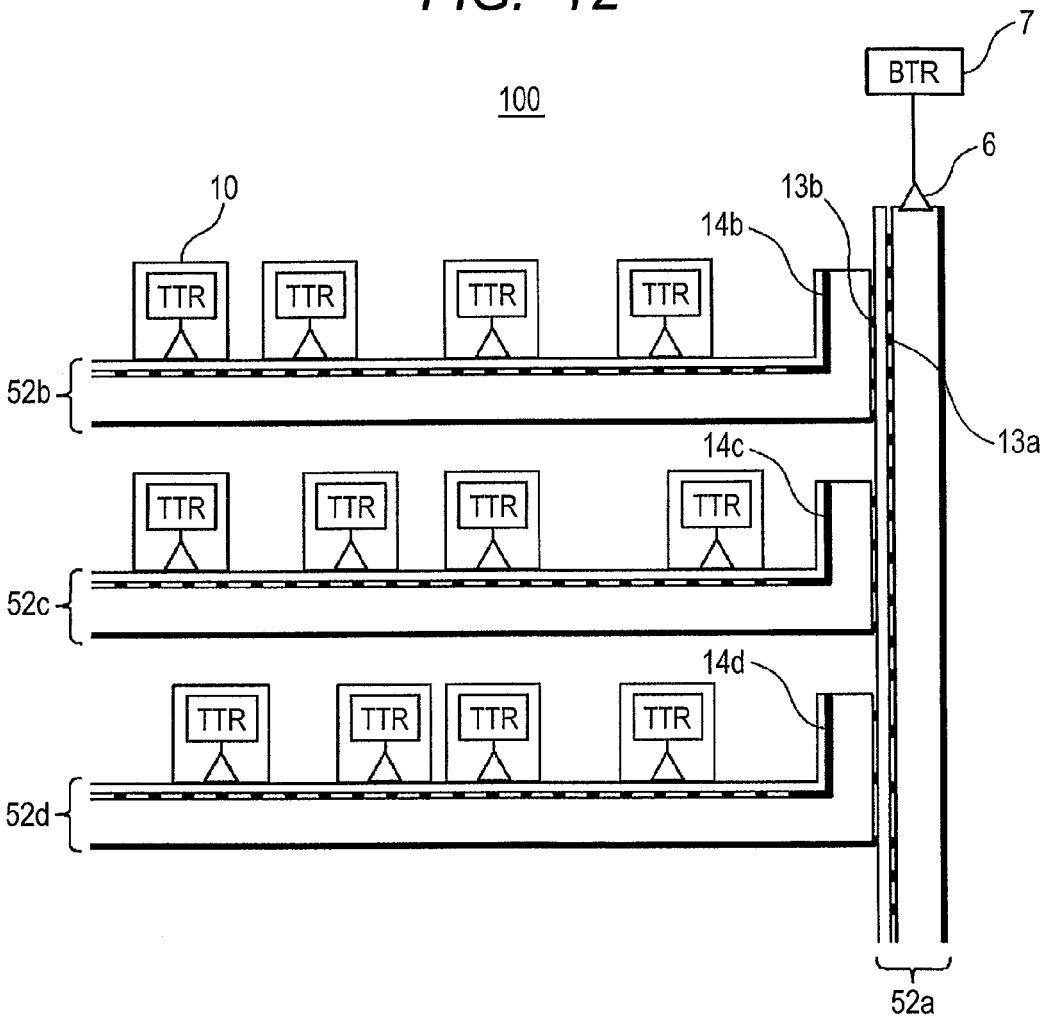
FIG. 12 is a sectional view showing another example of branching extension of the planar propagation media according to the third embodiment.

FIG. 12 illustrates a modified example of the electromagnetic wave propagation device 100 according to the embodiment. Shield conductors 14*b* to 14*d* are provided on surfaces of the respective overlapped parts between the first planar propagation medium 52*a* and the second planar propagation media 52*b* to 52*d* so as to further reduce leakage of the electromagnetic wave from the region where the communication terminal is not disposed.

Figure 13:
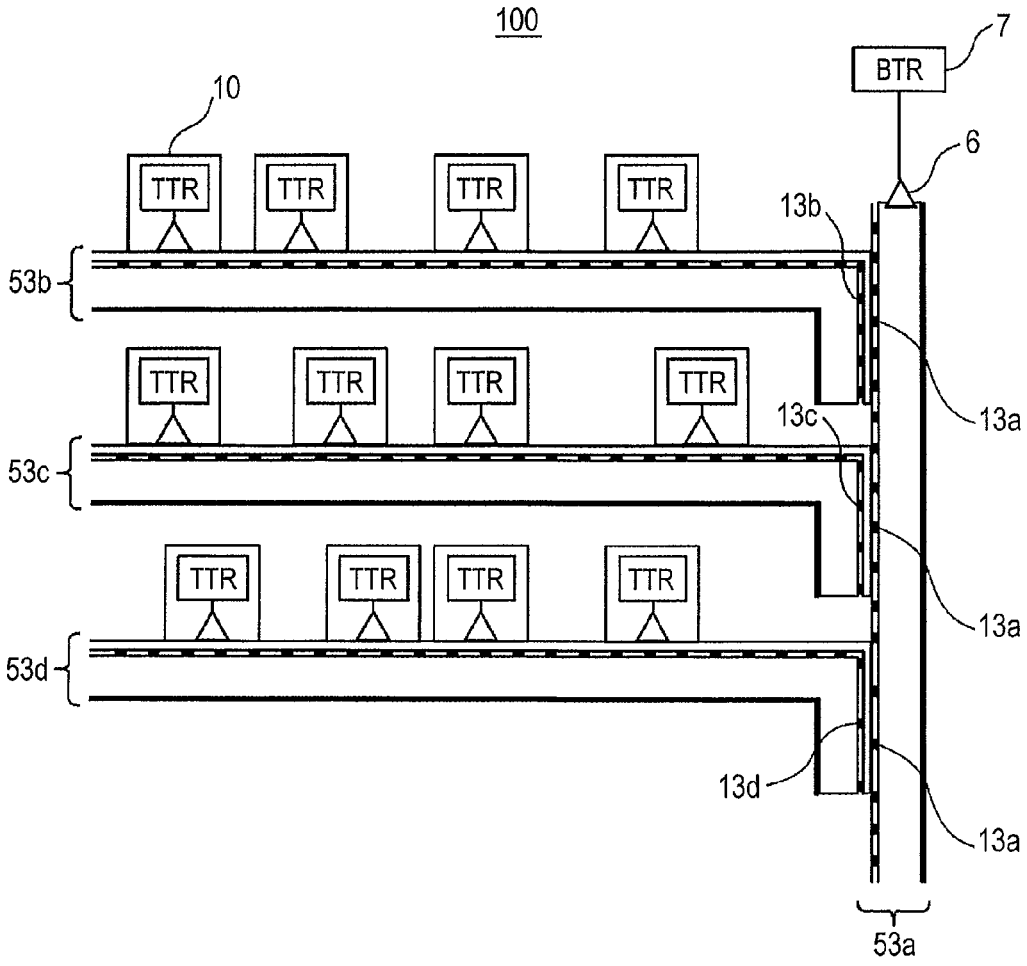
FIG. 13 is a sectional view showing another example of branching extension of the planar propagation media according to the third embodiment.

FIG. 13 also illustrates a modified example of the electromagnetic wave propagation device 100 according to the embodiment. The second planar propagation media 53*b* to 53*d* are bent toward the direction opposite the one as shown in FIG. 12, and connected to the first planar propagation medium 53*a*. One conductive layer of the planar propagation media 53*a* to 53*d* may be formed as the conductor with a completely flat surface, leading to improvement in mountability into the housing.

The electromagnetic wave propagation device 100 according to the third embodiment is configured to connect the two partially overlapped planar propagation media disposed in superposition via the sparse mesh conductor. This makes it possible to carry out the branching extension of the propagation path with low loss while keeping the low leakage characteristic and high resistance to interference wave. This makes it possible to allow highly reliable communication with the multiple communication terminals three-dimensionally disposed at various positions in the housing. The continuous mesh structure ensures to lessen fluctuation in the propagation efficiency caused by the positional displacement between the planar propagation media.

Fourth Embodiment

A fourth embodiment according to the present invention will be described referring to FIG. 14. The embodiment relates to a battery system with battery modules as a large number of electronic apparatuses which are three-dimensionally disposed in the housing.

Figure 14:
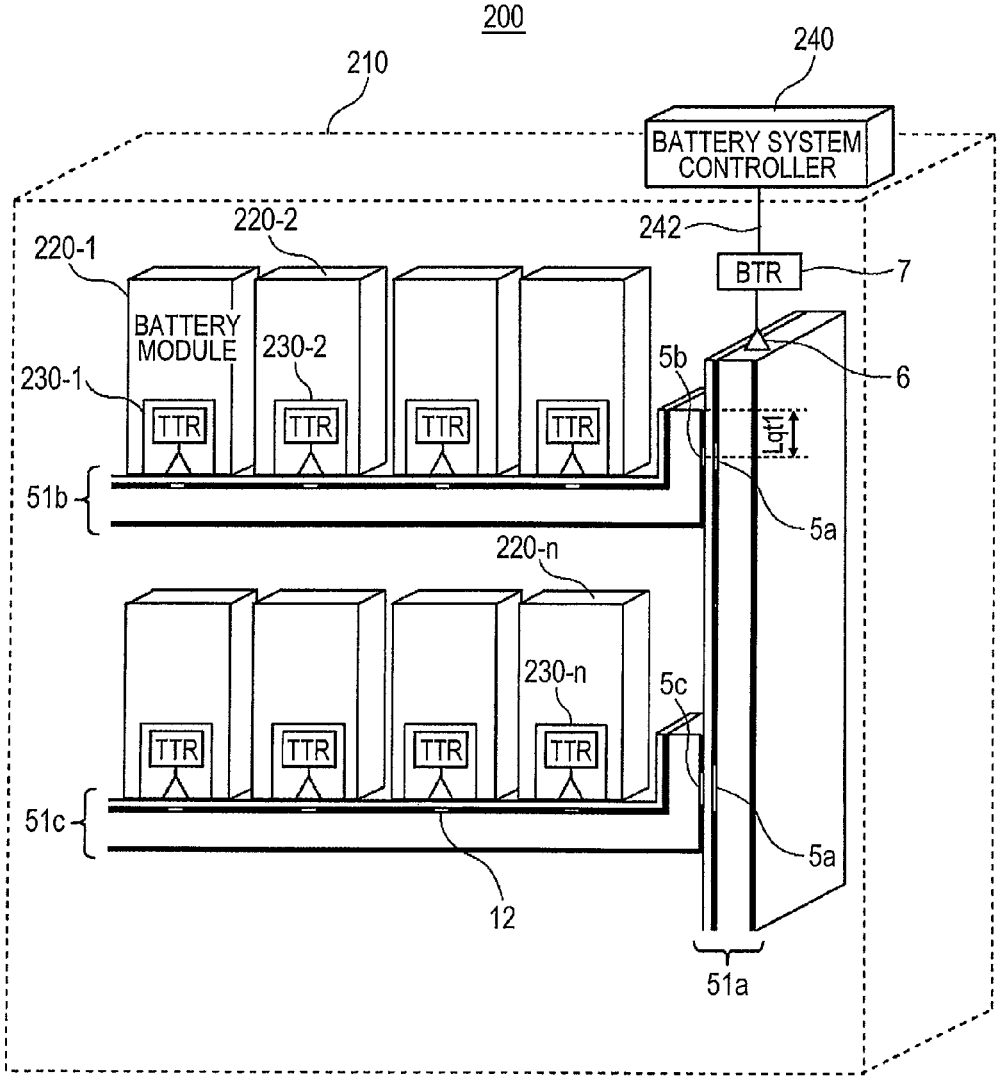
FIG. 14 is a perspective view illustrating an exemplary structure of an electronic apparatus having the electromagnetic wave propagation device in a housing according to a fourth embodiment of the present invention.

FIG. 14 illustrates an exemplary structure of a battery system 200 according to the fourth embodiment. The battery system 200 includes multiple battery modules 220 (220-1 to **220-*n*) three-dimensionally disposed within a storage rack inside a housing 210, communication terminals 230 (230-1 to 230-*n*) as built-in transceivers corresponding to the respective battery modules, the electromagnetic wave propagation device 100 which connects the respective communication terminals 230 with the communication base station 7, and a battery system controller 240 connected to the communication base station 7 via a control bus 242. In this embodiment, the electromagnetic wave propagation device 100 shown in FIG. 6 is disposed within the storage rack corresponding to the multi-path environment inside the housing 210 so as to carry out the communication for transmitting and receiving information such as the control signal and data between the communication terminals 230 and the battery system controller 240. The respective battery modules 220 are controlled by the battery system controller 240. It is to be clearly understood that the electromagnetic wave propagation device 100** of any other embodiment may be employed.

The electromagnetic wave propagation device allows the branching extension of the propagation path with low loss while keeping the low leakage characteristic and the high resistance to the interference wave. This makes it possible to carry out the highly reliable communication between the communication terminals 230 of the multiple battery modules 220 which are three-dimensionally disposed at various positions inside the housing 210, and the battery system controller 240. The use of the electromagnetic wave propagation device 100 eliminates the risk of destabilizing communication quality caused by the irregular reflection of the electromagnetic wave by the metal wall surface of the housing. The use of the electromagnetic wave propagation device 100 further eliminates the need of individual wiring, thus realizing the high pressure resistance, flexibility of installation position, and easy maintenance. The multiple planar propagation media may be connected to the electronic apparatuses without using the generally employed detachable connector, which does not expose the electrode and requires no physical fixing. This makes it possible to improve reliability, and reduces the assembly and maintenance costs as well as to enhance the high pressure resistance. It is also possible to feed power for activating the battery modules by applying functions of the power transmission device and the power receiving device to the communication base station 7 and the communication terminals 230.

The electromagnetic wave propagation device 100 according to the present invention includes a large number of three-dimensionally disposed multiple electronic apparatuses in the closed space inside the housing and indoor space, which is applicable to a system requiring highly reliable communication with the controller of a center, for example, a data center, a hard disk controller, a medical diagnostic system in a hospital, a traffic management center and the like.

REFERENCE SIGNS LIST

**1*a*, 1*b***: planar conductor
**2*a*, 2*b***: planar dielectric
**3*a*, 3*b***: planar dielectric spacer
41, **4*b***: planar mesh conductor
**5*a*, 5*b***: slot
6: parallel transformation type interface
7: communication base station
8: vertical transformation type interface
9: transceiver
10: communication terminal
**11*a*, 11*b***: planar conductor
12: slot
**13*a*, 13*b***: sparse mesh conductor
**14*b*-14*d***: shield conductor
**50*a*-53*a*, 50*b*-53*b***: planar propagation medium
100: electromagnetic wave propagation device
200: battery system

The invention claimed is:

1. An electromagnetic wave propagation device comprising:
multiple planar propagation media;
planar dielectric spacers disposed for isolating the multiple planar propagation media from one another; and
a first interface for transmitting and receiving an electromagnetic wave between the planar propagation media and a transceiver, wherein
each of the planar propagation media is formed by laminating at least one planar conductor and at least one planar dielectric;
each of the planar propagation media is disposed to have an overlapped part with at least another of the planar propagation media; and
the planar conductor is provided with an electromagnetic wave linking unit at the overlapped part that transmits and receives the electromagnetic wave between the planar propagation media.

2. The electromagnetic wave propagation device according to claim 1, wherein
the planar propagation medium is formed by laminating the planar conductor, the planar dielectric and a planar mesh conductor, sequentially; and
the planar mesh conductor transmits and receives the electromagnetic wave to and from the transceiver.

3. The electromagnetic wave propagation device according to claim 2, wherein a pitch of the planar mesh conductor of the planar propagation medium at the overlapped part is smaller than a pitch at a non-overlapped part.

4. The electromagnetic wave propagation device according to claim 1, wherein
a first planar conductor, the planar dielectric and a second planar conductor are sequentially laminated to form at least one of the planar propagation media; and
a slot is formed in the second planar conductor for transmitting and receiving the electromagnetic wave to and from the transceiver.

5. The electromagnetic wave propagation device according to claim 1, wherein a slot is formed in the planar conductor at the overlapped part as at least one of the electromagnetic wave linking units.

6. The electromagnetic wave propagation device according to claim 5, wherein the planar propagation medium is disposed so that a distance from an end surface to the slot in a propagation direction of the electromagnetic wave in the planar propagation medium is set to an integer multiple of effective quarter wavelength.

7. The electromagnetic wave propagation device according to claim 5, wherein a dimension of the slot formed in a first one of the planar propagation media is smaller than a dimension of the slot formed in a second one of the planar propagation media disposed having an obverse face of the first planar propagation medium partially overlapped with a reverse face of the second planar propagation medium.

8. The electromagnetic wave propagation device according to claim 1, wherein the planar conductor has a mesh structure at the overlapped part as at least one of the electromagnetic wave linking units.

9. The electromagnetic wave propagation device according to claim 1, wherein the planar propagation media are disposed so that the overlapped part between the two planar propagation media in a propagation direction of the electromagnetic wave in the planar propagation medium has a distance set to an integer multiple of effective quarter wavelength.

10. The electromagnetic wave propagation device according to claim 1, wherein the multiple planar propagation media are configured to have a first planar propagation medium and multiple second planar propagation media;

the second planar propagation medium includes the overlapped part structured to have at least a part overlapped between an obverse face of the second planar propagation medium and a reverse face of the first planar propagation medium in a same propagation direction as a propagation direction of the electromagnetic wave in the first planar propagation medium, and a portion of the second planar propagation medium is bent in relation to the overlapped part to incline the propagation direction of the electromagnetic wave to the second planar propagation media; and the first planar propagation medium and the multiple second planar propagation media are three-dimensionally branched for extension.

11. The electromagnetic wave propagation device according to claim 10, wherein the multiple second planar propagation media are connected in an axial direction of the first planar propagation medium at predetermined intervals so that the multiple planar propagation media are three-dimensionally branched for extension;

the electromagnetic wave from the first planar propagation medium is input to the planar propagation media via the electromagnetic wave linking units provided at the respective overlapped parts; and each distribution ratio of each electromagnetic wave from the first planar propagation medium to the second planar propagation media is adjusted in accordance with a dimension of the respective electromagnetic wave linking units.

12. The electromagnetic wave propagation device according to claim 10, wherein a parallel transformation type interface is connected to the first planar propagation medium;

the parallel transformation type interface is connected to a communication base station and is configured to transform one mode of the electromagnetic wave into another mode of the electromagnetic wave along an advancing direction of the electromagnetic wave;

an electronic apparatus is connected to the transceiver for transmitting and receiving the electromagnetic wave to and from the transceiver; and the transceiver is connected to the second planar propagation media via the first interface.

13. An electromagnetic wave propagation path comprising:

multiple planar propagation media; and planar dielectric spacers disposed for isolating the multiple planar propagation media from one another, wherein each of the planar propagation media is formed by laminating at least one planar conductor and at least one planar dielectric;

each of the planar propagation media is disposed to have an overlapped part with at least another of the planar propagation media; and the planar conductor is provided with an electromagnetic wave linking unit at the overlapped part for transmitting and receiving the electromagnetic wave between the planar propagation media.

14. The electromagnetic wave propagation path according to claim 13, wherein the planar conductor has a slot at the overlapped part as at least one of the electromagnetic wave linking units.

15. The electromagnetic wave propagation path according to claim 13, wherein the planar conductor has a mesh structure at the overlapped part as at least one of the electromagnetic wave linking units.

* * * * *